United States Patent [19]

Young

[11] Patent Number: 4,885,888

[45] Date of Patent: Dec. 12, 1989

[54] INSULATING NON-REMOVABLE TYPE CONCRETE WALL FORMING STRUCTURE AND DEVICE AND SYSTEM FOR ATTACHING WALL COVERINGS THERETO

[75] Inventor: David A. Young, Glen Ellyn, Ill.

[73] Assignee: Young Rubber Company, Naperville, Ill.

[21] Appl. No.: 120,973

[22] Filed: Nov. 16, 1987

Related U.S. Application Data

[63] Continuation-in-part of Ser. No. 799,933, Nov. 20, 1985.

[51] Int. Cl.[4] ..... E04B 2/00

[52] U.S. Cl. ..... 52/426; 52/564

[58] Field of Search ..... 52/426, 428, 562, 563, 52/564, 565, 568

[56] References Cited

U.S. PATENT DOCUMENTS

| | | | |
|---|---|---|---|
| 2,916,793 | 12/1959 | Ellis | 52/565 |
| 4,162,728 | 7/1979 | Uzumcu | 206/345 |
| 4,177,617 | 12/1979 | DeLuca | 52/562 |
| 4,655,014 | 4/1987 | Krecke | 52/426 |

FOREIGN PATENT DOCUMENTS

| | | | |
|---|---|---|---|
| 125336 | 9/1947 | Australia | 52/564 |
| 2010133 | 11/1971 | Fed. Rep. of Germany | 52/564 |
| 2801570 | 7/1979 | Fed. Rep. of Germany | 52/426 |
| 19814 | 11/1892 | United Kingdom | 52/564 |

*Primary Examiner*—Henry E. Raduazo

*Attorney, Agent, or Firm*—Charles F. Meroni, Jr.

[57] ABSTRACT

A synthetic plastic wall tie of variable lengths for use with concrete forms. The tie has a pair of T-shaped end sections at its opposite ends. Each of the T-shaped end sections including a stem having a sufficient thickness for receiving an end of a screw in threaded engagement therewith. The T-shaped end sections have parallel cross pieces at opposite ends of the tie. An intermediate wall tie section connects the T-shaped end sections together. The intermediate wall tie section has a pair of round flange-like water-stops extending radially outwardly out of the intermediate wall tie section and are joined therewith in integral one-piece assembly therewith. The water-stops serve to inhibit water flow axially of the wall tie and through a concrete wall structure where the tie is embedded. The round flange-like water-stops further serve to provide means for locating reinforcing rods extending at right angles to the wall ties when the wall ties are mounted in a concrete form.

9 Claims, 3 Drawing Sheets

INSULATING NON-REMOVABLE TYPE CONCRETE WALL FORMING STRUCTURE AND DEVICE AND SYSTEM FOR ATTACHING WALL COVERINGS THERETO

CROSS-REFERENCE TO RELATED APPLICATIONS

This application is a continuation in part of co-pending U.S. application Ser. No. 799,933 filed Nov. 20, 1985 and now Pat. No. 4,730,422. This application is also related to Ser. No. 799,932 now U.S. Pat. No. 4,706,422.

BACKGROUND OF THE INVENTION

Field of the Invention

The present invention relates to a new and improved synthetic plastic concrete forming system. The present invention also concerns a new and improved synthetic plastic concrete wall tie for use in the concrete forming system. Still another part of the invention relates to a new and improved system and method for affixing wall coverings to a modular synthetic plastic concrete form structure.

Prior to the development of the new synthetic plastic wall ties herein disclosed, metal wall ties having cones at opposite ends have been known in the art. These types of ties were laid into the form and the concrete was then poured. After the concrete had hardened, the worker would then hammer the ends of the wall tie causing the wall tie to fracture. This type of metal wall tie is called a "snap tie", and when it is struck the cone shaped ends are fractured, and then they can be removed from the formed concrete wall. Thereafter, the concrete worker will then fill the conical holes to provide a smooth finished surface. The new ties herein disclosed are of a different construction and function in a different way in that they are provided with disc shaped members which are formed integrally with the tie. Ideally these synthetic plastic discs or stops could be made of a larger diameter. It has been the further practice of concrete wall makers to use wall ties having metallic washer-like elements which would be slid onto the ends of the wall tie. The wall tie has spaced stops so that when the metal washer elements are moved into place on the wall tie that they would then be bottomed against the stops at the inside edge of the washers. The concrete functions to hold the washers in place against the stops on the tie. The new and improved wall ties herein disclosed are provided with stops that are integral and immobile and positively fixed on the tie and being made from plastic will not corrode. Also, it should be noted that the metal ties and the metal washers that were used in the past, were inferior in construction since there was a definite tendency for these metal components to breakdown and corrode thus creating a potential water leakage problem at least in certain types of wall construction.

According to certain other features of my invention, my new and improved synthetic plastic concrete wall tie has a pair of round flange-like water-stops extending radially outwardly out of an intermediate wall tie section, the water-stops serving to inhibit water flow axially or along the length of the wall tie and through a concrete wall structure where the tie is embedded, the round flange-like water-stops further serving to provide means for locating reinforcing rods extending at right angles to the wall ties when the wall ties are mounted in a concrete form.

According to still other features of my invention, I have provided a new and improved synthetic plastic wall tie that has unique end formations which enable the wall tie to be easily attached with slotted form sections where the slots extend in rows along upper and lower edges of the form section.

Still other features of my invention are concerned with a new and improved synthetic plastic wall tie comprised of 20% calcium carbonate filled polypropylene of sufficient thickness to allow attachment screws to be threaded into opposite ends of the tie to anchor wall coverings to a poured concrete wall structure.

According to other important features of my invention, I have provided a new and improved synthetic plastic concrete wall tie which is totally modular in that it can be used and mounted in slots in wall sections synthetic plastic concrete forms from either edge of the tie.

According to still other important features of my invention, I have provided a new and improved synthetic plastic concrete wall tie having water-stops that can also act as reinforcing rod locating fingers which assist in providing one or more pockets for a concrete reinforcing rod to minimize movement of the reinforcing rod as concrete is poured into the form.

In the past, it will be appreciated that different types of foamed plastic concrete forming systems have been used in industry and, in this connection, attention is drawn to U.S. Pat. Nos. 3,552,0786 and 3,788,020. These patents relate generally to concrete forms formed from low density foamed plastic and polymeric material but where the forms do not possess the improvements herein described and illustrated.

SUMMARY OF THE INVENTION

A synthetic plastic wall tie of variable lengths for use with concrete forms comprising a pair of T-shaped end sections at opposite ends of the wall tie, each of the T-shaped end sections including a stem having a sufficient thickness for receiving an end of a screw in threaded engagement therewith, the T-shaped end sections having parallel cross pieces at opposite ends of the tie, an intermediate wall tie section having a pair of round flange-line water-stops extending radially outwardly out of the intermediate wall tie section and being joined therewith in integral one-piece assembly therewith, the water-stops serving to inhibit water flow axially of the wall tie and through a concrete wall structure where the tie is embedded, the round flange-like water-stops further serving to provide means for locating reinforcing rods extending at right angles to the wall ties when the wall ties are mounted in a concrete form, the cross pieces having outer faces positioned generally at right angles to a plane through the length of the wall tie enabling a screw to be screwed there through into the associated stem for attaching a wall cover thereto, the synthetic plaster ties being comprised of 20% calcium carbonate filled polypropylene which constitutes a material suitable for receiving a screw assembly therewith.

A synthetic plastic wall tie of variable lengths for use with concrete forms comprising a pair of T-shaped end sections at opposite ends of the wall tie, each of the T-shaped end sections including a stem having a sufficient thickness for receiving an end of a screw in threaded engagement therewith, the T-shaped end sections having parallel cross pieces at opposite ends of the tie, an intermediate wall tie section connecting the T-shaped end sections together, the intermediate wall tie section having a pair of round flange-like water-stops extending radially outwardly out of the intermediate wall tie section and being joined therewith in integral one-piece assembly therewith, the water-stops serving to inhibit water flow axially of the wall tie and through a concrete wall structure where the tie is embedded, the round flange-like water-stops further serving to provide means for locating reinforcing rods extending at right angles to the wall ties when the wall ties are mounted in a concrete form, the cross pieces having outer faces positioned generally at right angles to a plane through the length of the wall tie enabling a screw to be screwed there through into the associated stem for attaching a wall cover thereto.

A method of securing a wall covering to a concrete wall structure, the steps of forming synthetic plastic wall forming sections from a foamed plastic material with rows of tie slots at spaced intervals along upper and lower edges and with indicia formed on outer wall surfaces of the forming section so that the indicia and the slots are transversely aligned in pairs along the edges enabling the indicia to act as a tell tale for the slots and wall ties, securing opposite ends of synthetic plastic concrete wall ties in the slots of the wall forming sections to provide a reinforced form structure, securing transverse closure sections between the wall forming sections to provide form closures, pouring concrete in the thus formed concrete forming structure and immersing and binding the ties in the concrete, screwing fasteners through a wall covering, the panel section into the wall tie using the indicia as a blind concrete tie locator for aligning the screw with the hidden wall tie enabling the screw to be screwed into the tie to securely fasten the wall covering thereto.

DESCRIPTION OF THE PREFERRED EMBODIMENTS

Figure 1:
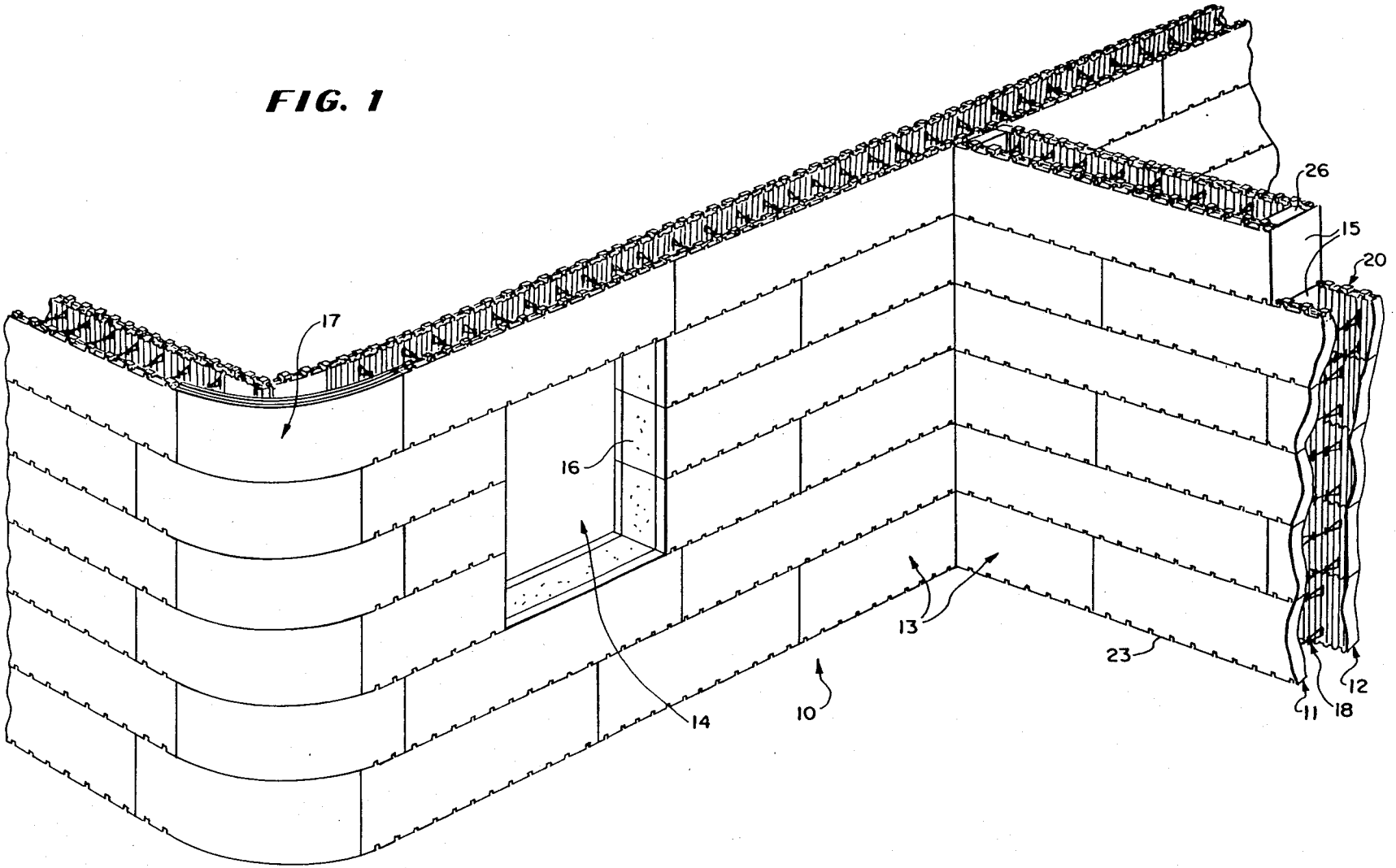
FIG. 1 is an enlarged fragmentary cross-sectional view of a modular foamed plastic concrete form structure as disclosed in my parent application, U.S. Ser. No. 799,933.

The reference numeral 10, as seen in FIG. 1, designates generally a modular foamed plastic concrete form structure. The structure that is shown in FIG. 1 is also shown in my co-pending U.S. application for patent entitled: "A PERMANENT NON-REMOVABLE INSULATING TYPE CONCRETE WALL FORMING STRUCTURE", Our Case No. 85600-2 U.S. Ser. No. 799,932 filed Nov. 20, 1985 which is co-pending with the present application. The disclosure of my co-pending application is here incorporated by reference. The present application is also a continuation in part of my co-pending U.S. application for patent entitled: "AN INSULATING NON-REMOVABLE TYPE CONCRETE WALL FORMING STRUCTURE AND DEVICE AND SYSTEM FOR ATTACHING WALL COVERINGS THERETO", our Case No. 85601-2, U.S. Ser. No. 799,933 filed Nov. 20, 1985 and now U.S. Pat. No. 4,730,422.

The structure 10 is comprised of a pair of modular concrete forming panels 11 and 12 which are spaced from one another and which when properly installed serve to act as a form into which concrete may be poured. The panels are each comprised of a series of modular concrete forming sections 13 which are all identical to one another with certain exceptions, as hereafter described. These sections are adapted to be cut and arranged so as to enable window openings 14 to be easily constructed. Cooperable with the panels 11 and 12 are end closure panels 15 which extend transversely between the forming panels 11 and 12 and between the forming sections 13 so as to confine poured concrete. It will further be seen that the window openings are also provided with closure panels 16. All of the panels 11, 12, the sections 13, the closure panels or end pieces 15, the window panels 16 and curved corner panels 17 are comprised of foamed plastic preferably an expandible polystyrene. This material has been found to have unique insulating properties and strength so as to enable concrete walls to be better insulated to impede transmission of heat through a formed wall as will be further described at another point herein.

In order to properly reinforce the concrete forming structure 10, I have developed a new and improved wall tie 19 which is comprised of 20% calcium carbonate filled polypropylene as a preferred embodiment. The improved wall tie 19 can be used in much the same way as wall tie 18 shown in FIG. 1. The wall tie 18 corresponds to the one disclosed in my parent U.S. application for patent as noted above. As a preferred construction, I have made the tie as a one piece unit. Less desirably the tie mentioned also could be made as a multiple part construction.

My thermal wall system is a whole new concept in energy efficient building technology. The building block sections of expanded polystyrene serve as a permanent form for concrete. This system of construction is for use where energy conservation and speed of construction are important.

Expanded polystyrene or EPS is a closed cell, rigid, lightweight cellular plastic, white in color, that is molded into various shaped with steam and pressure. Thermal wall system panels are made of modified polystyrene. The density of the panels range between 1.7 and 2.0. Typical physical properties of EPS insulation is given in Table 1 below. Like all organic materials, EPS is combustible and should not be exposed to flame or other ignition sources.

TYPICAL PHYSICAL PROPERTIES OF EPS

| Property | | Units | ASTM Test | Density (pcf) 10 | 125 | 15 | 20 |
|---|---|---|---|---|---|---|---|
| Thermal Conductivity | at 25° F. | BTU/(hr) | C177 or | 023 | 022 | 021 | 020 |
| K Factor | at 40° F. | (sq ft)(F/in) | C518 | 024 | 0235 | 022 | 021 |
| | at 75° F. | | | 026 | 0255 | 024 | 023 |
| Thermal Resistance | at 25° F. | at 1 inch | | 435 | 454 | 476 | 500 |
| Values (H) | at 40° F. | Thickness | — | 417 | 425 | 455 | 476 |
| | 75° F. | | | 385 | 392 | 417 | 435 |
| Strength Properties | | | | | | | |
| Compressive 10% Deformation | | psi | D1621 | 1014 | 1318 | 1521 | 533 |
| Flexural | | psi | C203 | 2530 | 3238 | 4050 | 575 |
| Tensile | | psi | D1623 | 1620 | 1721 | 1822 | 2327 |
| Shear | | psi | D732 | 1822 | 2325 | 2632 | 3337 |
| Shear Modulus | | psi | — | 280320 | 370410 | 460500 | 600640 |
| Modulus of Elasticity | | psi | — | 180220 | 250310 | 320360 | 460500 |
| Moisture Resistance | | | | | | | |
| WVT | | perment | C355 | 1230 | 1128 | 0925 | 0615 |
| Absorption(vol) | | percent | C272 | less than 25 | less than 25 | less than 20 | less than 10 |
| Capillarily | | — | — | none | none | none | none |
| Coefficient of Thermal Expansion | | in/(in)(F) | D696 | 0000035 | 0000035 | 0000 | 0000035 |
| Maximural Service Temperature | | °F. | — | | | | |
| Long term | | | | 167 | 167 | 167 | 167 |
| Intermillent | | | | 180 | 180 | 180 | 180 |

Figure 7:
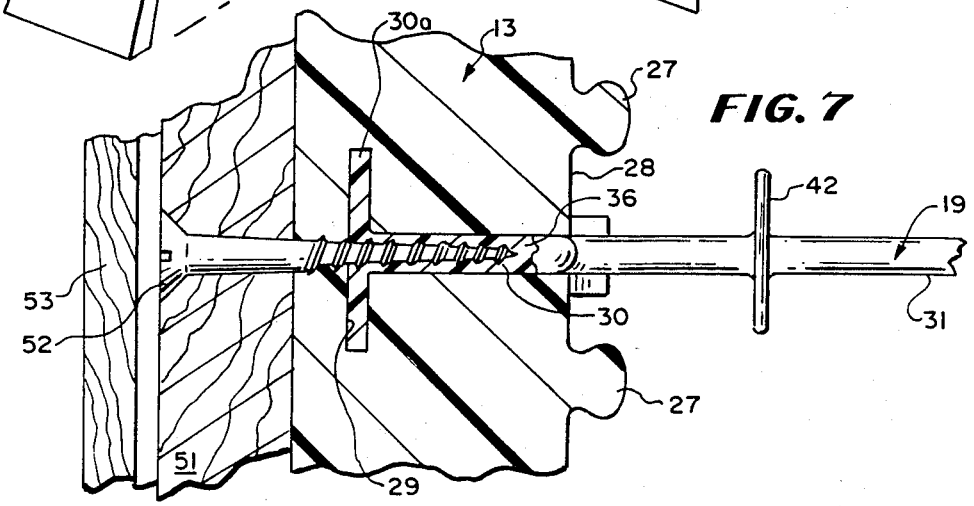
FIG. 7 is an enlarged fragmentary section taken on line 7—7 looking in the direction indicated by the arrows as seen in FIG. 3.

All values based on data available from American Hoechst Corporation ARCO Chemical Company, and BASF Wyandolle Corporation The basic building components of my thermal wall system are the two solid 2" panels 11 and 12 of polystyrene connected together with high impact plastic ties 18. The length of the tie 18 or 19 determines the width of the concrete wall. Each block or section 13 has castellations 20 along its top edge or surface 21 and matching castellations along its under edge 23 (FIG. 1). The blocks or sections 13 are placed one on top of the other and pressed together using simple hand pressure. The castellations mesh together creating a completely smooth surface that is interlocked. The vertical ends of the block or section 13 are tongue 24 and groove 25 (FIG. 7) and interlock as well. The blocks or sections 13 are erected directly on top of footings or on the floor slab, as design dictates. The footings must be level and flat. When placing concrete, particular care should be taken in the first lift to check the horizontal and vertical levels.

Each of the end closures 15 vertically extending alternating hooked shaped ribs and grooves generally indicated at 26 which are shaped like and complementary to book shaped ribs 27 and hooked shaped grooves 28 (FIG. 8) to enable opposite ends of the end closure 15 to be slid into interlocked assembly with the opposed sections 13, 13. The sections have the ribs 27 and grooves 28 formed integral with the associated section 13 and when set up, the ribs 27 and the grooves 28 on the opposed panels 11 and 12 confront one another.

Figure 2:
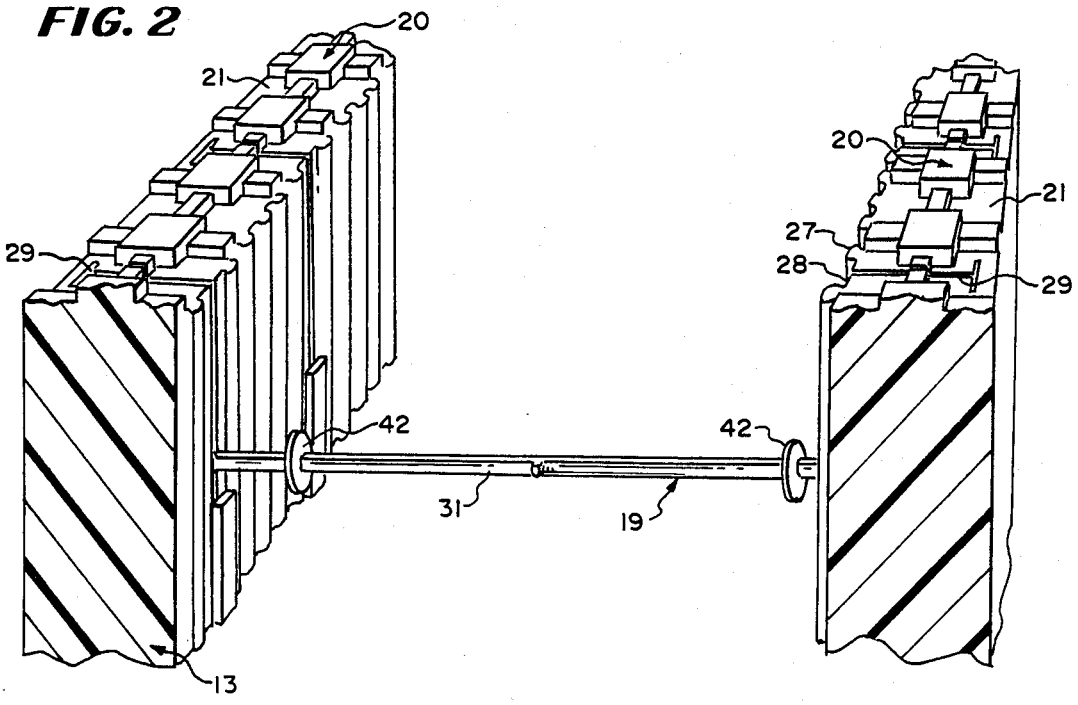
FIG. 2 is an enlarged perspective view partially in section showing a concrete form structure having my new wall tie which embodies important features of my invention.
Figure 3:
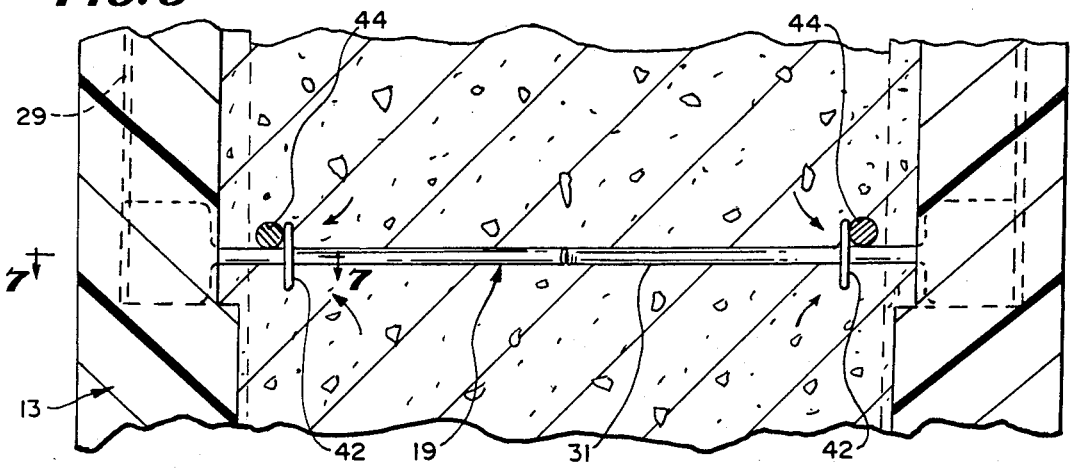
FIG. 3 is an enlarged vertical section of a concrete filled modular synthetic plastic concrete form structure embodying still further features of my invention.

The ties 18 or 19 are adapted to coact with upper and lower rows of T-shaped slots 29 which are formed in each of the sections 13. The slot 29 opens on an inner side so that the T-shaped slots oppose one another when two sections 13—13 are placed in opposed relation such as is shown in FIG. 2. The ties 19 are provided with T-shaped tie ends 30—30 which have a configuration that matches the shape of the slots 29 so as to be slideably engageable together when assembled with the sections. The ties 19 when engaged with the opposed sections along their upper and lower edges provide a sturdy concrete form structure.

Figure 4:
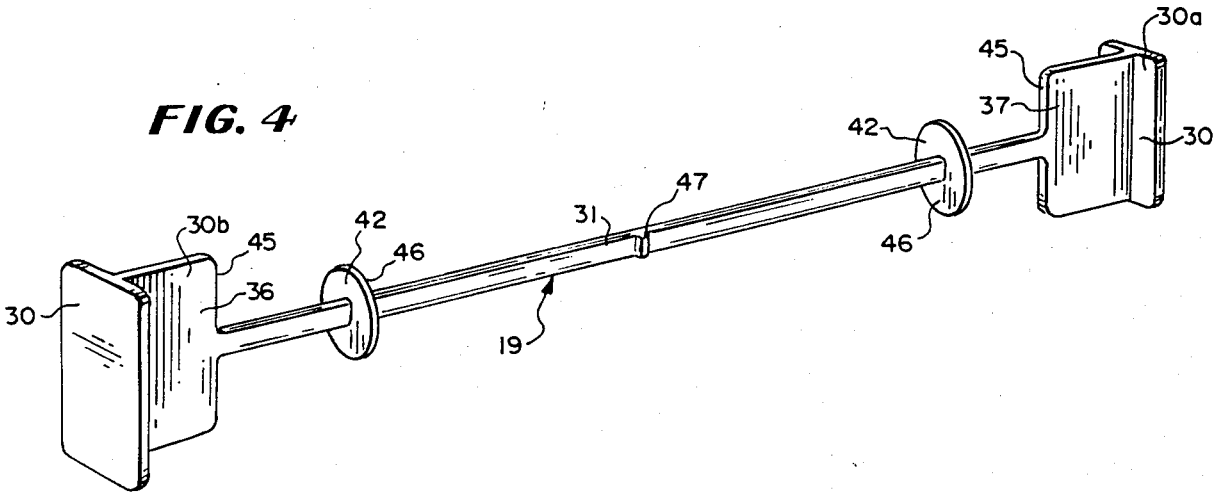
FIG. 4 is an enlarged perspective view of a wall tie further illustrating the tie shown in FIGS. 2 and 3.
Figure 5:
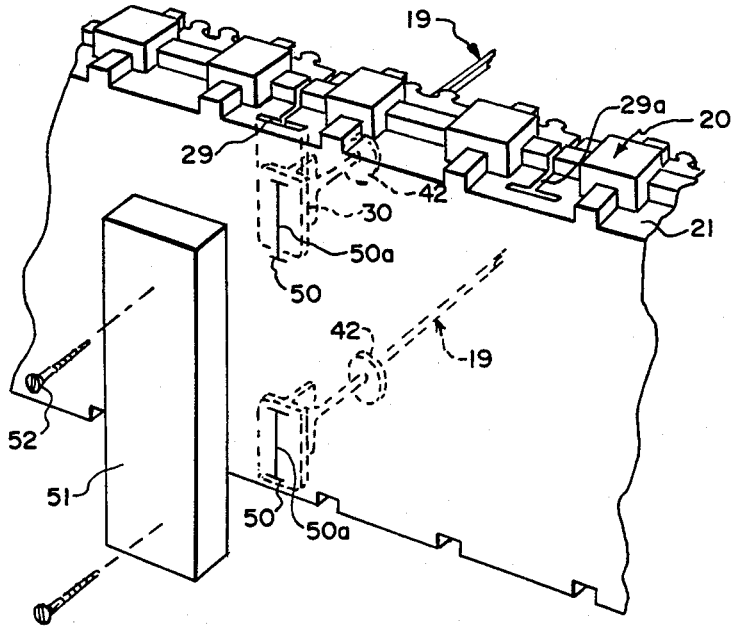
FIG. 5 is an exploded fragmentary vertical section of a modular synthetic plastic concrete form structure and illustrating the manner by which wall coverings can be attached thereto using my new wall tie.

It will be noted from comparing FIGS. 4 and 5 of my parent U.S. application Ser. No. 799,933 filed Nov. 25, 1985 that there are two different types of ties there disclosed and these ties have been identified as ties 18 and 18'. The ties 18 and 18' are essentially identical except that the tie 18' is a shorter tie and can be used where narrower concrete walls are to be formed such as having a thickness of 8". The longer ties 18 are adapted to be used in the formation of concrete walls having a thickness of 10". The length of the ties can be varied as required. The ties 19 are similar in construction to the ties 18' and the differences will be pointed out hereafter. The tie 18 here shown in FIG. 4 can be similarly varied and used.

With respect to the ties 19, each tie has an intermediate wall tie section 31', and a pair of triangular truss sections 32 are disposed on opposite ends of the mid-section 31' in integral one piece assembly therewith. The intermediate web section 31' joins the truss sections at the apexes of triangles of the triangular truss sections. As stated, the triangular truss sections 32 and 33 define triangular truss openings 34 and 35. It is these openings that have been created to enable concrete to flow freely through the ties in an unimpeded manner so that the ties will not act as dams to confine the flow of liquid concrete in the molds or forms as the concrete is poured.

The intermediate wall tie section 31 terminates in end portions 36 and 37 which in turn merge into the T-shaped tie ends 30—30. Each of the tie ends includes a cross piece portion **30*a* and a stem portion 30*b***.

The ties 19 are also provided with a pair of round flange-like water-stops 42—42 extending radially outwardly of the intermediate wall tie section 31. The stops 42 coact with the wall tie section 30 for receiving reinforcing rods 44 on either side of the stops. If desired, the rods 44 can be wired to the ties. The diameter of the rods can vary depending on the requirements of the builder. Typically, the diameter can run from ½" to ⅞". The water-stops 42 are preferably located a distance of 2½ from an inner end most adjacent to the stem portion **30*b* as indicated at 45 in FIG. 4 to an outer face 46 on the water-stop 42. The position of the water-stops can be varied so that the water-stops can be moved closer to mold gate 47 (FIG. 4) if desired. Generally it is not practical to move the water-stops 42 closer to the end face 45 of the stem portions 30*b* so that sufficient space can be provided for the reinforcing rods 44. It is generally desired to not dispose the reinforcing rods 44 closer that 2< from the outer surface of the concrete wall to be poured. By providing a 2" clearance between the outer face of the concrete wall being poured and the outside face of the reinforcing rod 44**, then the reinforcing rod can be sufficiently removed from the outside face of the concrete wall to minimize problems that might otherwise be generated should the rod be positioned too closely to the outside faces of the concrete wall to be poured.

In my preferred construction, the tie 19 is 12" in length and can be longer if desired. It has been found that where the ties are constructed so as to be provided with the water-stops 42 defining the notches 43 that the concrete rods 44 can be more fixedly located at the point in time when the liquid concrete is poured into the form so that the reinforcing rods will not bounce and move as the concrete C is poured thereon.

The water-stops 42 can operate to provide the notches 43 where the wall tie is disposed in either position with either side of the wall tie being positioned top side of the wall tie.

The wall tie 19 preferably has its water-stop 42 formed with a diameter of at least 1" and has a thickness of approximately 0.100". Excellent results can be achieved where my wall tie is so constructed with water-stops of the construction and dimensions as set forth above.

According to other important features of my invention, I have provided embossed I-shaped indicia 50 as seen in FIG. 5. The embossed I-shaped indicia 50 are vertically spaced in rows on an outer face adjacent to upper and lower edges of each section 13 in transverse alignment with the T-shaped slots 39 that open on the opposite surface or face of the section 13. The embossed I-shaped indicia 50 have an upstanding portion 58 that is in transverse alignment with a stem portion **29*a* of the notch 29 (FIG. 5**).

The embossed I-shaped indicia 50 is provided on both sides of the section and opposite each row of the T-shaped slots and the spacing of the embossed I-shaped indicia may be varied as required. This spacing of the indicia may be of the order of every 6" along the length of the section.

Figure 6:
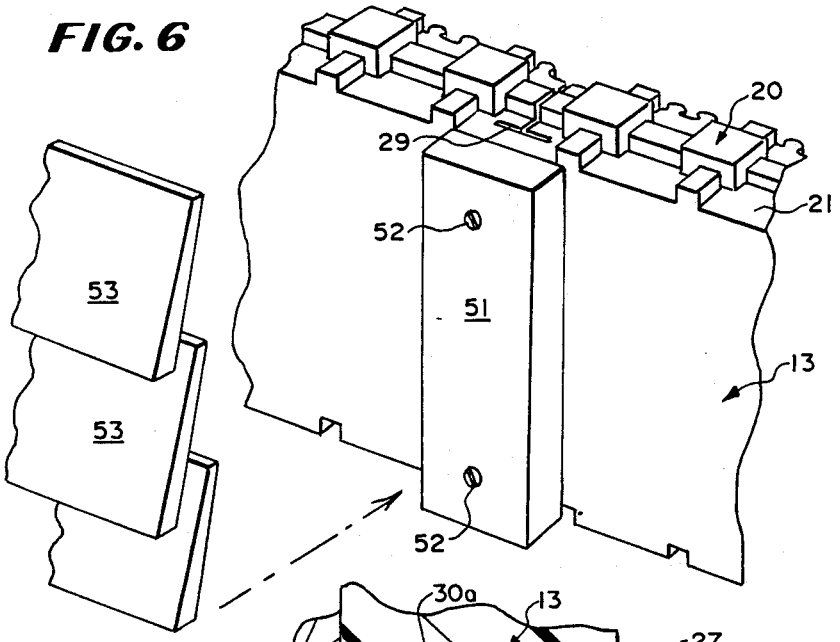
FIG. 6 is an enlarged fragmentary exploded view of a modular synthetic plastic concrete form structure similar to that shown in FIG. 5 only with the components being in a more advanced stage of assembly.

The embossed I-shaped indicia 50 serve as a "tell tale" or as a "blind slot locator" to enable furring strips 51 to be attached by screws 52 (FIGS. 5, 7) in such a way that the screws can be screwed directly into the ties 18 and, more particularly, through the T-shaped end 30 of the tie to firmly anchor the furring strip 51 to the section 13. Thereafter, a wall covering 53 can be suitably attached to the furring strips 51 by additional screw fasteners as indicated at 54 in FIG. 6.

The ties 18 (FIG. 1) and 18' (not here shown but see parent U.S. Applications noted before) are otherwise identified as the long tie 18 and the short tie 18' are preferably constructed having the following approximated dimensions:

| | Length of Tie | Height of Tie | Thickness of Flat End | Width of Stem of T-shaped End |
|---|---|---|---|---|
| Long Tie | 11" | 2 3/16" | 3/16" | 1 5/16" |
| Short Tie | 9" | 2 3/16" | 3/16" | 1¼" |

| | Width of Intermediate Truss Section | Length of Finger | Diameter of Finger |
|---|---|---|---|
| Long Tie | 1 13/16" | ½" | 3/16" |
| Short Tie | 1¼" | 5/8" | 3/16" |

| | Length of Vertical Truss Legs | Length of Diagonal Truss Legs | Diameter of Diagonal Truss Legs |
|---|---|---|---|
| Long Tie | 1¾" | 3 1/16" | 3/16" |
| Short Tie | 1¾" | 2 3/8" | 3/16" |

The ties 19 have not been made the subject of a test study similar to the test study ran with the ties 18 but it is my belief based on my knowledge and experience with the manufacture of ties of this type that if the ties 19 were made of the same material, that comparable test results would be attainable.

The ties 18 have been tested and have been found to have the following approximated test characteristics:

TEST STUDY OF
CALCIUM CARBONATE FILLED
POLYPROPYLENE TIES

| PROPERTY | UNIT | ASTM METHOD | LPP6020 (20%) | LPP6030 (30%) |
|---|---|---|---|---|
| Tensile Strength at 73° F. | psi | D638 | 4,000 | 3,500 |
| Elongation at Break | % | D638 | 80 | 70 |
| Flexural Strength at 73° F. | psi | D790 | 4,800 | 4,950 |
| Flexural Modulus (tangent) | psi × $10^5$ | D790 | 2.6 | 2.9 |
| Flexural Modulus (1% Secant) | psi × $10^5$ | | 2.4 | 2.6 |
| Izod Impact at 73° F. Notched (½" × ¼" bar) | ft/lb/in. | D256(1) | .75 | .8 |
| Izod Impact at 73° F. Unnotched (½" × ¼" bar) | ft-lb/in. | D256 | 12 | 15 |
| Gardner Impact | in-lb | — | 20 | 30 |
| Heat Deflection Temperature, 66 psi | °F. | D648 | 210 | 220 |
| Specific Gravity | — | D792 | 1.05 | 1.14 |
| Hardness, Shore "D" | — | D2240 | 72 | 73 |
| Melt Flow | g/10 min. | D1238(2) | 4–6 | 4–6 |
| Mineral Content | % | —(3) | 20 | 30 |

-continued

| TEST STUDY OF CALCIUM CARBONATE FILLED POLYPROPYLENE TIES | | | | |
|---|---|---|---|---|
| PROPERTY | UNIT | ASTM METHOD | LPP6020 (20%) | LPP6030 (30%) |
| Mold Shrinkage | in/in | — | .012 | .011 |

(1)Method A
(2)Condition L"L
(3)Burn-out at 850° F.
Mold Shrinkage is intended as a guide only, as specific shrinkage is affected by part design, mold design, and molding conditions.
The values listed herein are to be used as guides, not as specification limits. Determination of product suitability in any given application is the responsibility of the user.

My thermal wall structure introduces a new building product made of expandable polystyrene which serves as a permanent form for concrete construction. This products main advantages are its speed of erection and the very high thermal insulation properties attained (R-Value of 20+).

Similar products have been used extensively in Switzerland, Belgium, France, Germany, Venezuela, Australia and now the United States. It has been in use for nearly 20 years. It is a simple building system: Hollow blocks made of ARCO Dylite Expandable Polystyrene, with a flame retardant additive, are erected "Lego" fashion by means of their toothed tops and grooved bottoms. Plastic ties hold the sides together and the length of the tie determines the width of the cavity or wall, the blocks are interlocked both horizontally and vertically. Once erected, concrete is poured into the cavity of the wall creating an insulated load bearing structure.

My thermal wall building blocks or sections 13 are composed of panels of EPS (Expandable Polystyrene) that are 2" thick, 12" high and 40" or 20" long. The density is nearly twice that of conventional insulation board. A whole range of exterior finishes can be applied. Scores of elastomeric coatings and stucco finishes may be used as well as siding or paneling. Interiors are finished with drywall, plaster, tile or in any other traditional manner.

My thermal wall structure is an advanced system of construction for use where energy conservation (by reduction of thermal transmission) and speed of construction (reduced labor costs) are important.

The inherent low thermal fluctuations ensure that the risk of cracking of any external rendering and internal plaster-work are non-existent. The maximum possible expansion is 0.2 mm/m.

Excellent noise and impact sound reduction is also an important advantage of the Thermal Wall System. Remembering that a difference of 10 dB almost halves the volume of noise. 350 Ka/m2 Thermal Wall 250 mm is at 49 dB.

Expandable Polystyrene does not rot and when used properly in building construction it is not subject to any other kind of deterioration while in service.

Panels of "Dylite" Expandable Polystyrene are 2" thick, 12" high and 40" or 20" long. The horizontally spaced rows of "t" or T-shaped slots 29 are disposed along the top and bottom of each section. T-shaped ends 30—30 of the ties 19 are inserted into the slots 29. These ties 19 hold the sections 13 and the panels 11 and 12 together and also determine the width of the wall. Each blocks or sections 13 have the castellations 20 along its top surface and matching castellations along the underside as previously described. The blocks 13 are placed one on top of the other and pressed together using simple pressure; the castellations mesh together creating a completely smooth surface and solid structure. The blocks are erected directly on top of footings or on a floor slab, as design dictates. The footings must be as level and flat as possible. When pouring concrete, particular care should be taken in the first three feet poured to check the horizontal and vertical levels, this is most important, as small errors and variations in the early levels will be greatly increased in height. The lightness of the blocks or sections 13 and the flexibility of them means erection can be both fast and simple.

For corners, windows, door openings and t-junctions an "endpiece" is also made of expandable polystyrene and is inserted into the end of the block. It slides into the block and acts as a bulkhead for concrete. It is held in place by surface corrugations on the insides of the block panels.

Corners of 90° are formed by interlocking blocks perpendicular to one another and inserting endpieces to bulkhead the concrete. With a 10 inch wall rounded corners are available by use of my specially made corner block or section 17.

Thermal wall blocks or sections 13 can be cut quickly and easily with any conventional hand saw. Sanding down the edge with a coarse abrasive block ensures a smooth tight fit.

The blocks or sections 13 are stacked to the desired height of 8 to 10 foot and are filled with regular concrete by means of a concrete truck and chute or with a concrete pump. A super plasticizer additive is recommended to aid in flowability of the concrete mix without detriment to the strength of the concrete. The concrete should be placed in "lifts" or layers of 4 foot, at a rate of 8 to 10 foot per hour.

Electric & Plumbing

Water supply lines and conduit for electric can be easily cut into the 2" thickness of the thermal wall, after the concrete has been poured. They are then covered with drywall or plaster. Pipes of greater diameter than 2", such as waste water pipes, should be placed in the wall cavity before the concrete is poured. Completely surrounded by concrete and thermal wall polystyrene, the pipe will be insulated and insensitive to frost even if the building is unheated.

The use of thermal wall blocks or sections 13 in construction makes possible the type of energy-efficient construction that is necessary today (and will be even more so in the future judging from the ever-increasing energy costs).

EPS (Expandable Polystyrene) panels 11 and 12 are connected together with the plastic ties 19 to form building blocks. These blocks interlock horizontally and vertically and are stacked one upon another to a desired height and filled with concrete.

The blocks remain in place after the concrete has been poured and provides the structure with an R-Value of 20.

R-Value means the resistance to heat loss and the R system is a way of rating insulation effectiveness: the higher the R-Value the greater the resistance provided against heat and cold.

T.W.S. blocks are formed from ARCO—"Dylite", a fire retardant EPS, and will not support combustion.

There are no limits to the types of wall coverings, both interior and exterior that may be applied. Generally the exterior is of a cemeticious finish and the interior is plastered or drywalled. Panels may be glued or screwed.

Some of the Advantages:

1. Rated R-20+: Stretches Energy Dollars.
2. Concrete cures under ideal conditions, down to −10 degrees C. and use of the sections 13 operates to extend the building season.
3. By using the sections 13 in block form, heating and air conditioning costs can be reduced by 50%.
4. The sections 13 and the formed blocks are fire retardant and will not support combustion.
5. Sound Proof.
6. Water Repellant.
7. Mold and mildew resistant and rot proof.
8. The sections 13 have no food value and insects cannot digest it.
9. The sections 13 are versatile and can be used both above and below grade for residential, multi-family and commercial construction, as well as high-rise construction.
10. My forms are lightweight and the interlocking procedures enable increased productivity with less construction time.
11. The sections and the formed blocks are air tight and voids and air filtration are virtually eliminated.
12. Wall thickness may vary from 6, 8 or 10" based on length of ties.
13. The rounded corner sections allow for increased design possibilities with no additional framing costs.
14. There is a complete absence of cracking of internal and external finishes and maximum possible expansion is 0.2 mm/m.
15. Use of my concrete forms enable a quicker return on Investment Dollars.

Limitations (a) Loading:

Thermal wall panels should not be installed under surfaces subject to heavy point loading; the E.P.S. does not add structural integrity to the wall; it simply insulates it.

(b) Solvents:

E.P.S. including thermal wall panels cannot be exposed to petroleum-based solvents, fuels or coal tar products and their vapors.

(c) Ultraviolet Degredation:

Prolonged exposure to sunlite (Ultraviolet rays) will cause E.P.S. material to discolor and a dusting of the surface will occur. Wall panels must be coverd to prevent degredation.

(d) Flammability:

The E.P.S. material used in forming thermal wall panels has a flame retardant additive but it should be considered combustable when directly exposed to a constant source of flame. It should not be installed near an open flame or other source of ignition. Current model building code requirements should be met for adequate protection.

I claim:

1. In a modular formed plastic concrete form structure, wherein the improvement comprises a pair of modular concrete forming panels each comprised of a series of modular concrete forming sections stacked on top of one another and also disposed in end-to-end relation, the sections each having means on its upper and lower edges and its opposite vertical edges for interlocking the sections in stacked, end-to-end engagement with one another, the panels being positioned in spaced opposed relation, spaced T-shaped tie slots in the opposed sections and which slots are hidden from view when viewing outer surfaces of the stacked forming sections, tie located indicia on outer surfaces of the forming sections for providing blind sighting means to enable screws to be screwed through a wall covering, the indicia, the forming section and into the synthetic plastic ties to securely anchor an exterior wall finishing covering to the forming sections, synthetic plastic wall ties for use with concrete forms, the wall having a pair of T-shaped end sections including a tie stem having a sufficient thickness for receiving an end of a screw in threaded engagement therewith, the T-shaped end sections having parallel cross pieces at opposite ends of the tie secured to said modular concrete forming sections, the tie cross pieces having outer tie faces positioned generally at right angles to a plane through the length of the wall tie enabling said screw to be screwed through into the associated tie stem for attaching a wall covering thereto, the tie having an intermediate wall tie section, the intermediate wall tie section having a pair of transversely spaced round flange-like water-stops spaced in gap relation between the concrete forming sections extending radially outwardly out of the intermediate wall tie section and being joined therewith in integral one-piece assembly therewith, the water-stops serving to inhibit water flow axially of the wall tie and through a concrete wall structure where the tie is embedded, the round flange-like water-stops further serving to provide means for locating reinforcing rods extending at right angles to the wall ties when the wall ties are mounted in gap relation to the concrete forming sections in a concrete form.

2. The wall tie of claim 1 further characterized by the water-stop being located approximately 2½ or more inward from an inside end of the nearest associated T-shaped end section.

3. The form structure of claim 1 further characterized by the tie locator indicia comprising longitudinally extending rows of I-shaped embossments extending along upper and lower edges of each section.

4. The form structure of claim 1 further characterized by the tie locator indicia comprising longitudinally extending rows of I-shaped embossments extending along upper and lower edges of each section, each embossment being transversely aligned with one of the slots.

5. In a modular synthetic plastic concrete form structure, wherein the improvement comprises a pair of modular concrete impervious forming panels comprised of a series of opposed modular concrete forming sections stacked on top of one another and also disposed in end-to-end relation, the sections each having means on its upper and lower edges and its opposite vertical edges for interlocking the sections in engagement with one another, the panels being positioned in spaced opposed relation, tie slots in the opposed sections positioned in longitudinally spaced rows along the upper and lower edges, synthetic plastic ties arranged in vertically spaced rows along upper and lower edges of the sections, the ties being positioned in vertically spaced horizontally extending rows and the ties having opposite enlarged tie ends retainingly engaged in said tie slots securing the sections in opposed spaced relation, modular transversely extending closure panels mounted between the opposed panels providing end closures for confining poured concrete within the form defined by the opposed panels and the end closure panels, modular attachment means provided between opposed faces of the opposed panels and opposite ends of the closure panels to secure the assemblage in unitary relation to define a concrete form, the ties and the forming sections having heights at substantial variance with respect to one another when said ties are assembled in the rows at upper and lower edges of the forming sections leaving a substantial open area between the upper and lower rows of ties enabling concrete to be rapidly poured between the forming sections with low flow impedance from the ties, the reinforcing ties each being secured in permanent embedded assembly at opposite ends with the synthetic plastic opposed panels and also with the concrete when poured and hardened in the thus provided form to provide an insulated concrete wall with the synthetic plastic panels permanently attached to the exterior of the concrete wall, the ties each having a pair of T-shaped end sections at opposite ends of the wall tie, each of the T-shaped end sections including a stem having a sufficient thickness for receiving an end of a screw in threaded engagement therewith, the T-shaped end sections having parallel cross pieces at opposite ends of the tie, an intermediate wall tie section connecting the T-shaped end sections together, the intermediate wall tie section having a pair of round flange-like water-stops extending radially outwardly out of the intermediate wall tie section and being joined therewith in integral one-piece assembly therewith, the water-stops being spaced inwardly of the forming section, the water-stops serving to inhibit water flow axially of the wall tie and through a concrete wall structure where the tie is embedded, the round flange-like water-stops further serving to provide means for locating reinforcing rods extending at right angles to the wall ties when the wall ties are mounted in a concrete form, the cross pieces having outer faces positioned generally at right angles to a plane through the length of the wall tie enabling a screw to be screwed there through into the associated stem for attaching a wall cover thereto.

6. The concrete form structure of claim 5 further characterized by the water-stop having a diameter of at least 1".

7. The concrete form structure of claim 5 further characterized by the water-stop having a thickness of 0.100".

8. The concrete form structure of claim 5 further characterized by the water-stop having a diameter of at least 1" and being 0.100" thick.

9. The concrete form structure of claim 5 further characterized by the water-stop being located approximately 2½ or more inward from an inside end of the nearest associated T-shaped end section.

* * * * *